US006851645B1

(12) United States Patent
Williams et al.

(10) Patent No.: US 6,851,645 B1
(45) Date of Patent: Feb. 8, 2005

(54) NON-COHERENT FRESNEL DIRECTION FINDING METHOD AND APPARATUS

(75) Inventors: Brett A. Williams, Arlington, TX (US); Brian C. Baker, Arlington, TX (US); Mark A. Turner, Arlington, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/729,066

(22) Filed: Dec. 5, 2003

(51) Int. Cl.[7] ..... F41G 7/00

(52) U.S. Cl. ..... 244/3.16; 244/3.15; 244/3.19; 342/61; 342/62

(58) Field of Search ..... 342/52–56, 61–65, 342/53; 244/3.1–3.3; 359/15, 386

(56) References Cited

U.S. PATENT DOCUMENTS 3,657,547 A 4/1972 Mansfield
4,085,910 A * 4/1978 Baker et al. ..... 244/3.16
4,143,835 A 3/1979 Jennings, Jr. et al.
4,900,914 A 2/1990 Raff et al.
5,432,623 A * 7/1995 Egan et al. ..... 359/15
5,490,643 A * 2/1996 Jano et al. ..... 244/3.11
5,529,262 A * 6/1996 Horwath ..... 244/3.16
5,784,156 A 7/1998 Nicholson
6,060,703 A 5/2000 Andressen
6,137,626 A * 10/2000 Takaoka ..... 359/386
6,219,185 B1 * 4/2001 Hyde ..... 244/3.16
6,307,521 B1 * 10/2001 Schindler et al. ..... 342/53
6,507,392 B1 1/2003 Richards et al.
6,565,036 B1 5/2003 Palathingal et al.
6,568,629 B1 * 5/2003 Perrin et al. ..... 244/3.14

* cited by examiner

*Primary Examiner*—Bernarr E. Gregory
(74) *Attorney, Agent, or Firm*—Sidley Austin Brown & Wood LLP

(57) ABSTRACT

A method and apparatus for finding a relative direction of received radiation is described. The received radiation is incident upon a window system at an angle and is transmitted therethrough. The magnitude of the transmitted radiation decreases as a continuous function of increasing angle of incidence, known as Fresnel transmittance. Opposing radiation detectors then detect this transmitted radiation, thereby creating a pair of detection signals, By dividing the difference of the detection signals by the sum of the detection signals, a processor generates a beta angle error curve and finds the relative direction of the radiation. Based upon this beta angle error curve, the processor generates an appropriate error correction signal for guiding an object based upon the relative direction of the received radiation. The method and apparatus are readily applicable to guiding munitions using a laser monopulse to designate a target.

60 Claims, 13 Drawing Sheets

NON-COHERENT FRESNEL DIRECTION FINDING METHOD AND APPARATUS

FIELD OF THE INVENTION

The present invention relates to a method of and apparatus for detecting radiation. In particular, the present invention provides for determining the relative direction from which radiation arrives, for example for munition guidance purposes.

BACKGROUND OF THE INVENTION

Advances in technology have led to improvements in the precision of guided munitions. However, as guidance systems have become more sophisticated, the need for even greater precision is apparent. As military targets are frequently found in civilian surroundings, highly precise guidance systems are required to destroy these military targets while minimizing collateral damage to the civilian surroundings. One approach to increasing the precision of guided munitions is through using a laser designator to illuminate the desired target. A quadrant detector within the radome of the guided munition then guides the munition to maximize the reflected laser signal received from the illuminated target.

While such laser guided munitions have been in operation for quite some time, the radome/detector design limits the velocity of these guided munitions. In particular, many of the radome/detector designs include a hemispherical radome. The velocity of a guided munition having a hemispherical radome is limited due to the radome's aerodynamic drag. In an effort to reduce this aerodynamic drag, the use of more conic-shaped radomes has been attempted. However, this change in radome shape has created problems for the detector system used to guide the munition. Moreover, the simple quadrant detectors used in a hemispherical radome are incompatible with the optical transmission properties of a more conic-shaped radome.

Further, while laser guided munitions exist, the requirement of using a continuous laser for illuminating the target is undesirable. The use of a continuous laser creates a beacon for anti-aircraft batteries wishing to destroy the aircraft guiding the munition. For this reason, the use of a pulsed laser is desirable. This creates additional guidance problems as the guided munition receives far less reflected laser signal, resulting in the need for more accurate guidance feedback based upon this limited reflected laser signal. This requirement for accuracy in spite of limited reflected laser signal is even greater when the velocity of the guided munition increases.

One alternative to the use of hemispherical, optical radiation based guidance systems is the use of radio frequency based guidance systems. Quadrant detectors based upon receiving radio frequency radiation permit more conic-shaped radomes. However, they require a local oscillator for coherent detection. For this reason, optical radiation based systems that do not employ coherent detection are desirable due to their reduced complexity.

Thus, a new approach for detecting an optical radiation signal that allows for greater guided munition velocities is needed that provides greater sensitivity for more accurate guidance of the munition. Moreover, a new approach is needed that is compatible with a conic-shaped radome.

SUMMARY OF THE INVENTION

A first embodiment of the invention is a direction finding system for determining the relative direction from which the direction finding system receives the radiation. The direction finding system includes a window system that transmits the radiation that is incident upon it. The window system has a window system optical axis based upon the configuration of the window system. In addition, the window system has Fresnel transmittance properties that cause the transmittance of the radiation through the window system to vary continuously as a function of incidence angle. The window system is configured such that radiation that is parallel to the window system optical axis, i.e., on boresight, is incident upon a surface of the window system at a boresight angle such that the instantaneous rate of change of the Fresnel transmittance as a function of angle of incidence at this boresight angle is significantly different than zero. The embodiment includes three or more radiation detectors for detecting the radiation. The radiation detectors are positioned relative to the window system to receive the radiation after transmission of the radiation through the window system. Each of the radiation detectors generates a respective detection signal. The embodiment further includes a processor that processes the detection signals and thereby determines the relative direction of the radiation with respect to the window system optical axis.

In a second embodiment of the present invention, a direction finding system based upon received radiation is used to control a guidable munition. This embodiment includes a body with control means, such as fins or thrusters, which respond to guidance signals. A radome attached to one end of the body includes a window system that transmits the received radiation. The window system has a window system optical axis, preferably coincident with a boresight of the guidable munition. Further, the window system has Fresnel transmittance properties. Lastly, the window system is specifically configured for radiation that is parallel to the window system optical axis. This parallel, boresighted radiation is incident upon a surface of the window system at a boresight angle such that the instantaneous rate of change of the Fresnel transmittance as a function of angle of incidence at this boresight angle is significantly different than zero. The guided munition also includes three or more radiation detectors that detect the received radiation after transmission through the window system. Each of these three or more radiation detectors generates a respective detection signal. A processor is included in the guided munition for processing the respective detection signals. The processor determines a relative direction of the radiation with respect to the window system optical axis using the detection signals. The processor then generates the guidance signals using the determined relative direction of the radiation and applies these signals to the control means.

The third embodiment differs from the first two direction finding system embodiments in that it uses a single radiation detector. As with the first two embodiments, the third embodiment includes a window system for transmitting the received radiation, the window system having a window system optical axis. The window system has Fresnel transmittance properties with respect to the transmitted radiation. For radiation parallel to the window system optical axis, i.e., on boresight, the window system is oriented such that this boresighted radiation is incident upon a surface of the window system at this boresight angle such that the instantaneous rate of change of the Fresnel transmittance as a function of angle of incidence at this boresight angle is significantly different than zero. The third embodiment employs a radiation detector to detect the radiation. The radiation detector is positioned relative to the window system to receive the radiation after transmission of the radiation through the window system. The radiation detector generates one or more detection signals based upon the received radiation. A processor in the third embodiment processes the one or more detection signals and thus determines the relative direction of the radiation with respect to the window system optical axis.

Yet another embodiment is a method for determining the relative direction of received radiation. The first step in the method is to transmit the radiation through a window system having specified properties. These specified properties include the window system having a window system optical axis and that the window system has Fresnel transmittance properties. The window system is configured such that radiation, which is parallel or boresighted to the window system optical axis, is incident upon a surface of the window system. This boresighted radiation is incident upon a surface of the window system at a boresight angle such that the instantaneous rate of change of the Fresnel transmittance as a function of angle of incidence at this boresight angle is significantly different than zero. Next, three or more radiation detectors detect the transmitted radiation, each radiation detector generating a respective detection signal. Lastly, the detection signals are processed to determine the relative direction of the radiation with respect to the window system optical axis.

BRIEF DESCRIPTION OF THE DRAWINGS

The present invention is described in reference to the following Detailed Description and the drawings in which.

DETAILED DESCRIPTION OF THE PREFERRED EMBODIMENTS

Figure 1A:
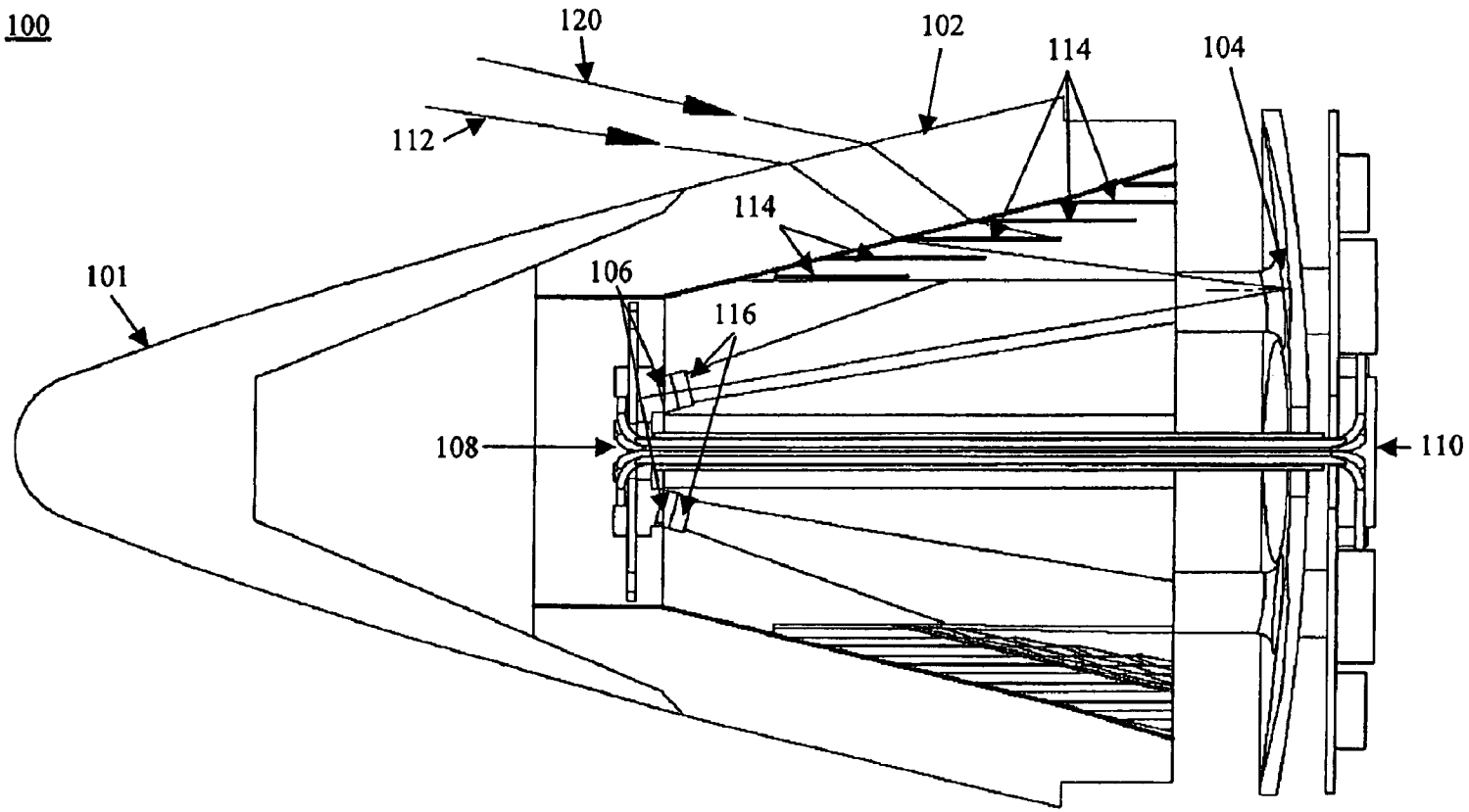
FIGS. 1*a*–1*b* are cross-sectional drawings of radomes incorporating a first embodiment of the present invention.

FIG. 1*a* illustrates a first embodiment of a direction finding system 100 for use in a guided munition. The direction finding system 100 includes a radome 101 with a window system 102 that transmits a radiation pulse 112, typically a laser pulse. The window system 102 must be made of a material that transmits the radiation pulse, but can also withstand aerodynamic heating due to the velocity of the guided munition. Moreover, the window system 102 must be able to withstand abrasion, such as that caused by dust or sand impacting the window system 102 at a high velocity. Based upon these requirements, fused silica is the preferred material for most laser pulse designators. Other possible window system materials may include ZnSe, $Al_2O_3$, and Ge. While the window system 102 shown in FIG. 1*a* is essentially a collar going around the entire radome 101, this need not be the case. Depending upon a number of factors, including shape of the radome 101, strength of the window system materials, manufacturability, and cost, it may be preferable to include a separate window for each radiation detector 106 in the direction finding system 100. In addition, while FIG. 1*a* illustrates a window system 102 having a constant thickness, FIG. 3*b* illustrates the case where the window system thickness varies linearly.

Upon transmission through the window system 102, a reflector 104 reflects the radiation pulse 112 onto the radiation detector 106. The reflector 104 preferably has a curved surface, thereby focusing the radiation pulse onto the radiation detector 106. Alternatives to a curved reflector 104 are reflective holograms and reflecting binary optics. The radiation detector 106, generates a detection signal when it absorbs the radiation pulse 112. The radiation detector 106 should be mechanically robust to withstand vibrations and stresses encountered during launch and flight of a guided munition. In addition, the radiation detector 106 must absorb the radiation pulse 112, thus selection of the radiation detector 106 depends upon the wavelength of the radiation pulse 112. Furthermore, the radiation detector 106 must respond to the frequently very short duration of the radiation pulse 112. Photodetectors comprised of semiconductor material typically meet these requirements and thus are the preferred radiation detectors 106. A wiring harness 108 transmits the resulting detection signals, one detection signal for each radiation detector 106, to a processor 110. While some signal processing, such as noise reduction, may be done for each individual detection signal, the detection signals are summed and differenced to determine the relative direction from which the radiation pulse 112 came.

Figure 1B:
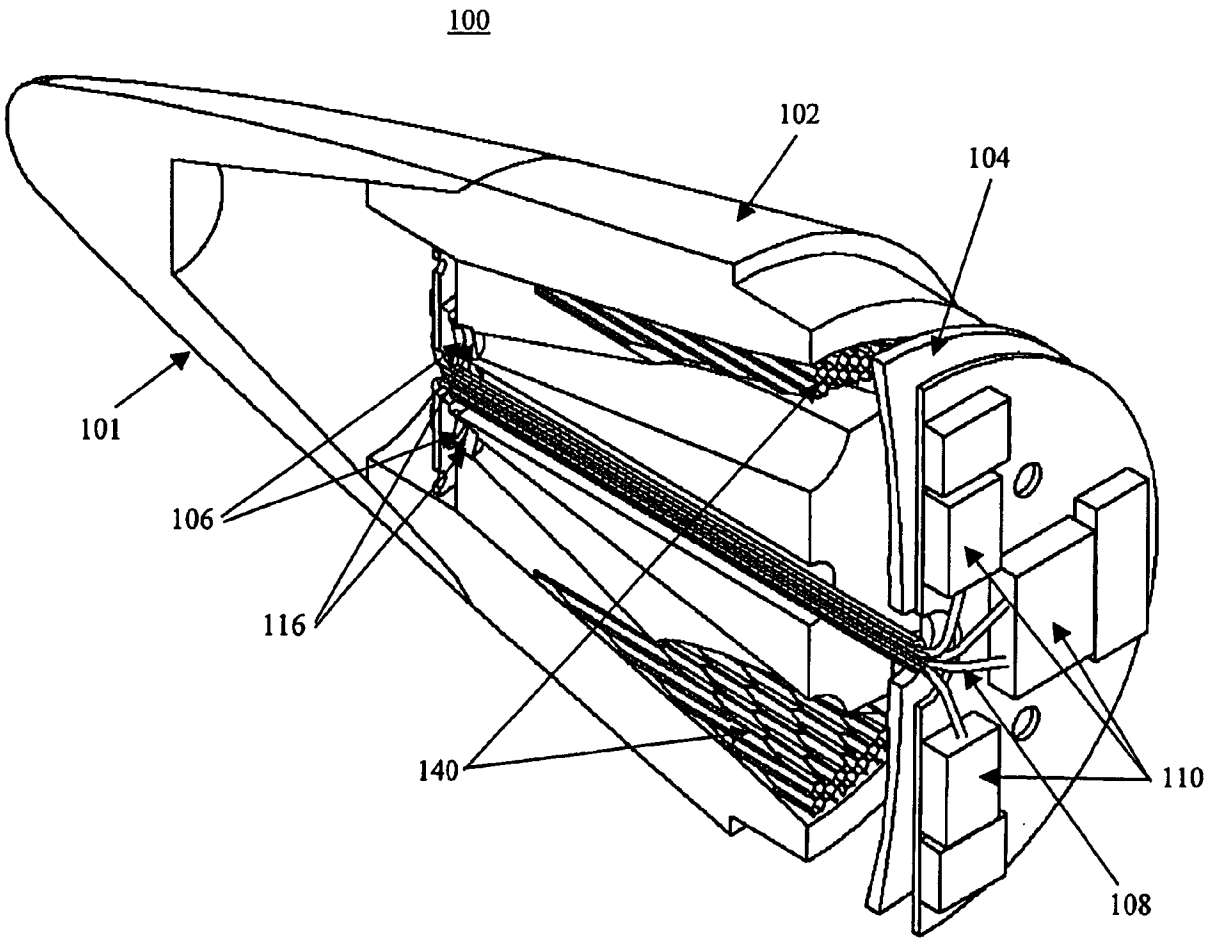

Several additional, optional elements may serve to further reduce the noise of the direction finding system 100. The first additional elements are light baffles 114. The light baffles 114 form a series of coaxial hollow cylinders that only transmit radiation pulses 112 incident at certain angles. As an example, radiation pulse 120 is incident at an angle greater than radiation pulse 112. As a radiation pulse intended to guide the munition should be found within a given solid angle of the guided munition, a radiation pulse outside of this given solid angle should be ignored. Such stray radiation pulses 120 could be from a second target illuminated by a different laser designator. Alternatively, the radiation pulse 120 could be a countermeasure. In either of these cases, the guidance system should ignore these stray radiation pulses 120. By employing light baffles 114, the stray radiation pulses 120 are blocked and absorbed by the light baffles 114 prior to being absorbed by the radiation detectors 106. As shown in FIG. 1*b*, light tubes 140 are an alternative to the light baffles 114. A light tube, much like a soda straw, would only transmit a radiation pulse that is nearly parallel to the axis of the light tube. Radiation pulses that are not nearly parallel to the axis of the light tube would be blocked and absorbed, much as with the light baffles.

Another method of reducing the noise of the guidance system is to use a radiation filter 116 as shown in FIG. 1*a*. The radiation filter 116, placed in front of the radiation detector 106, blocks a portion of the radiation incident thereon. The radiation filter 116 is preferably a bandpass filter. The method of constructing such a bandpass filter is well know in the art and thus a discussion of the design and construction of a bandpass filter is omitted here. The bandpass filter would transmit radiation within a given wavelength range, while blocking substantially all other radiation. By designing the bandpass filter to transmit radiation of the same wavelength used in the radiation pulse 112, the radiation filter 116 would block radiation pulses of different wavelengths, perhaps resulting from countermeasures and/or background radiation. When a laser creates the radiation pulse 112, use of a very narrow bandpass filter is possible as the wavelength band of the laser pulse is very narrow.

Figure 2A:
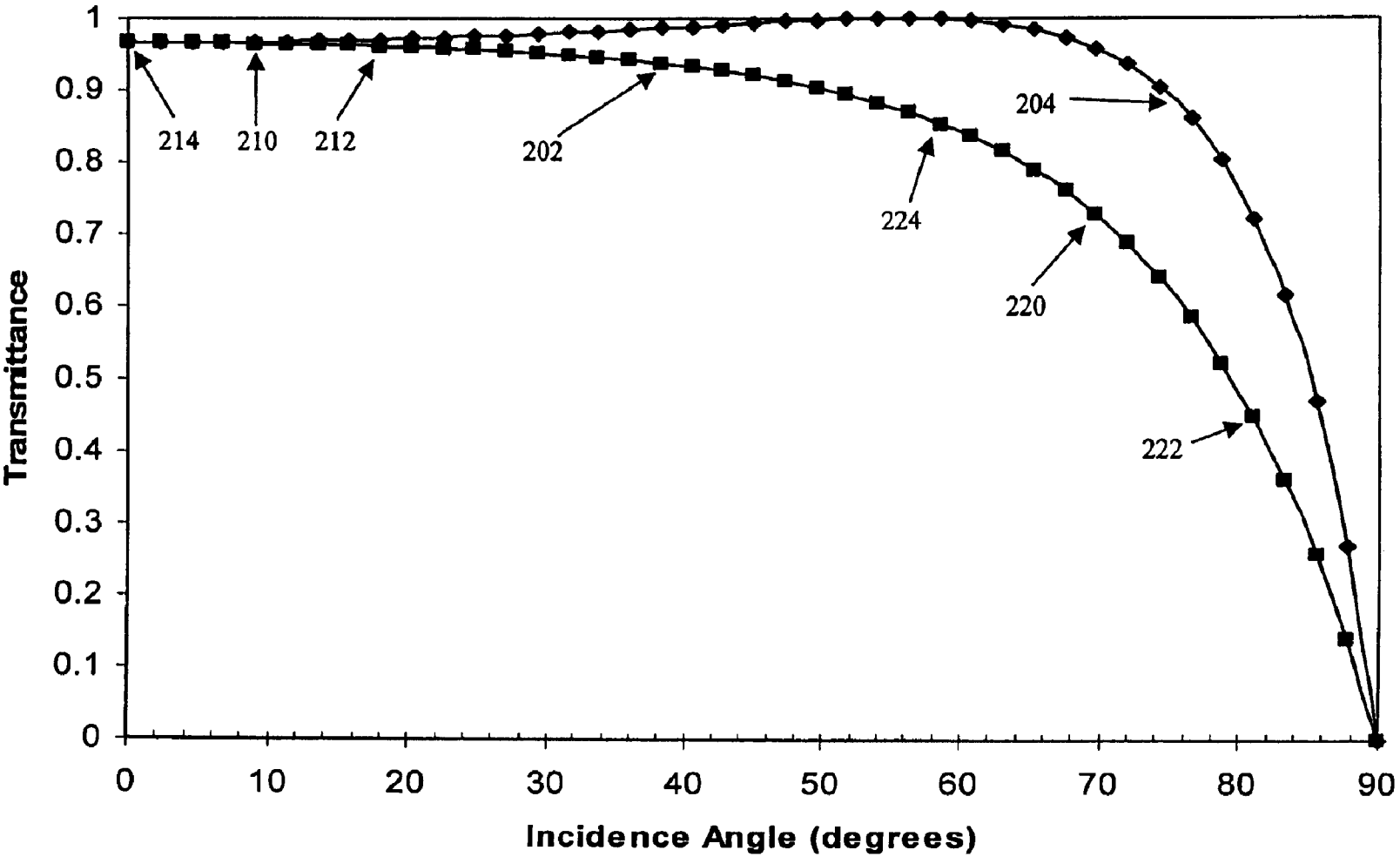
FIGS. 2*a*–2*b* are plots showing the Fresnel transmittance of radiation through an air/fused silica interface of the first embodiment of the present invention.

To permit high velocities for the guided munition, a steeply raked radome is desirable. The use of a steeply raked radome provides significant advantages to the present invention. As seen in FIG. 2*a*, the transmittance of radiation, as a percentage, through an air/fused silica interface is a strong function of both incidence angle and polarization based upon Fresnel's equations:

$$t_s=2n_i \cos(\theta_i)/[n_i \cos(\theta_i)+n_t \cos(\theta_t)], \text{ and} \quad \text{Eq. 1}$$

$$t_p=2n_i \cos(\theta_i)/[n_i \cos(\theta_t)+n_t \cos(\theta_i)]. \quad \text{Eq. 2}$$

In Fresnel's equations, Eq. 1 and Eq. 2, $t_S$ corresponds to the transmittance for S-polarized (perpendicular) radiation and $t_P$ corresponds to the transmittance for P-polarized (parallel) radiation. $\theta_i$ and $\theta_t$, correspond to the angles of incidence and transmission, respectively. Lastly, $n_i$ and $n_t$ correspond to the indices of refraction for the incident and transmitted materials, respectively. This dependence of the transmittance upon the angle of incidence shall be defined as Fresnel transmittance. Curve 202 shows the Fresnel transmittance $t_S$ for radiation incident upon the air/fused silica interface, while curve 204 shows the Fresnel transmittance $t_P$. At low angles, such as point 210 at 10 degrees, corresponding to a blunt or hemispherical radome, Fresnel transmittance is not a strong function of angle at all. More specifically, for an incident angle of 10 degrees, radiation received within an angle of plus 10 degrees (point 212) to minus 10 degrees (point 214) shows virtually no difference in Fresnel transmittance, regardless of polarization. In other words, the instantaneous rate of change of the Fresnel transmittance as a function of angle of incidence at 10 degrees is approximately zero. In contrast, an incident angle of 70 degrees (point 220), corresponding to a relatively sleek radome, shows significant differences in Fresnel transmittance for angles plus or minus 10 degrees. In other words, the instantaneous rate of change of the Fresnel transmittance as a function of angle of incidence at 70 degrees is significantly different from zero, i.e., the Fresnel transmittance is rapidly changing as a function of angle of incidence. For an incident angle of 70 degrees, radiation received within an angle of plus 10 degrees (point 222, 45% transmittance) to minus 10 degrees (point 224, 85% transmittance) shows a difference in Fresnel transmittance of 40% for S-polarized radiation. Thus, a sleek radome system benefiting from the Fresnel transmittance has a greater angular sensitivity than a blunt or hemispherical radome system. For guidance control, especially of a high velocity munition, the guidance system requires high angular sensitivity. Because the Fresnel transmittance is a strong function of incidence angle, yielding greater angular sensitivity, application of this varying transmittance for guidance purposes is useful. To benefit from the Fresnel transmittance, the incidence angle should be selected such that the Fresnel transmittance of the radiation varies significantly over the desired field of view, i.e., the slope of the Fresnel transmittance is significantly different from zero. The above example employed a field of view of plus or minus 10 degrees and a fused silica-based window system 102. Under these conditions, a minimum angle of incidence of at least approximately 60 degrees is preferred, with at least approximately 70 degrees being more preferred. The maximum incidence angle is approximately 80 degrees when a plus or minus 10 degree field of view is required. Note that these minimum and maximum incidence angles are a function of the window system material and the field of view. Referring again to FIG. 2, narrower fields of view will require greater minimum angles to ensure that the Fresnel transmittance varies significantly over the desired field of view. Based upon Fresnel's equations, Eq. 1 and Eq. 2, different indices of refraction will change the shape of the Fresnel transmittance curve, and thus the minimum angle of incidence. For example, $Al_2O_3$ has a greater index of refraction than fused silica, and therefore would require a smaller minimum angle of incidence. One of skill in the art will appreciate that these and other system parameters, including detector sensitivity, will determine how great the instantaneous rate of change of the Fresnel transmittance as a function of angle of incidence would need to be to achieve a required angle sensitivity.

Figure 2B:
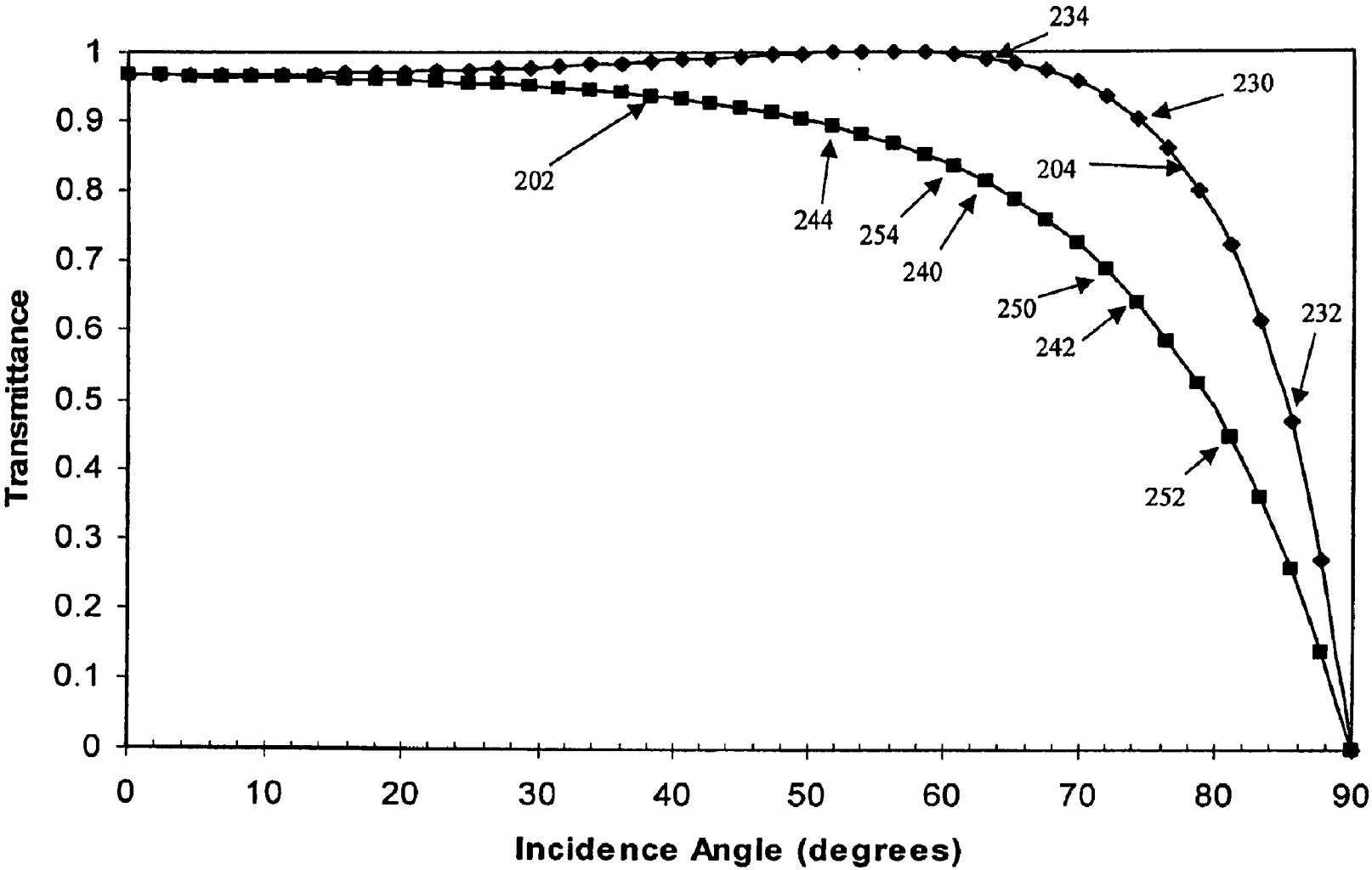

Specifying a middle field of view transmittance is an alternative method for defining a direction finding system design and is illustrated in FIG. 2*b*. For example, for a middle field of view Fresnel transmittance of 90% for P-polarized radiation (point 230), a plus or minus 10 degree field of view provides a change in Fresnel transmittance of approximately 50% (points 232 and 234). A middle field of view Fresnel transmittance of 80% for S-polarized radiation (point 240) provides a change in Fresnel transmittance of approximately 25% (points 242 and 244) over the plus or minus 10 degree field of view. A middle field of view Fresnel transmittance of 70% would be preferable for the S-polarized radiation (point 250) as the plus or minus 10 degree field of view change in Fresnel transmittance increases to 40% (points 252 and 254). Because of this continuous or smooth variation in Fresnel transmittance as a function of incidence angle, even a single radiation detector can provide some indication of the angle of incidence if properly calibrated. However, at least three radiation detectors are preferred to provide the level of control desired for a precision guided munition traveling at a high velocity.

Figure 3A:
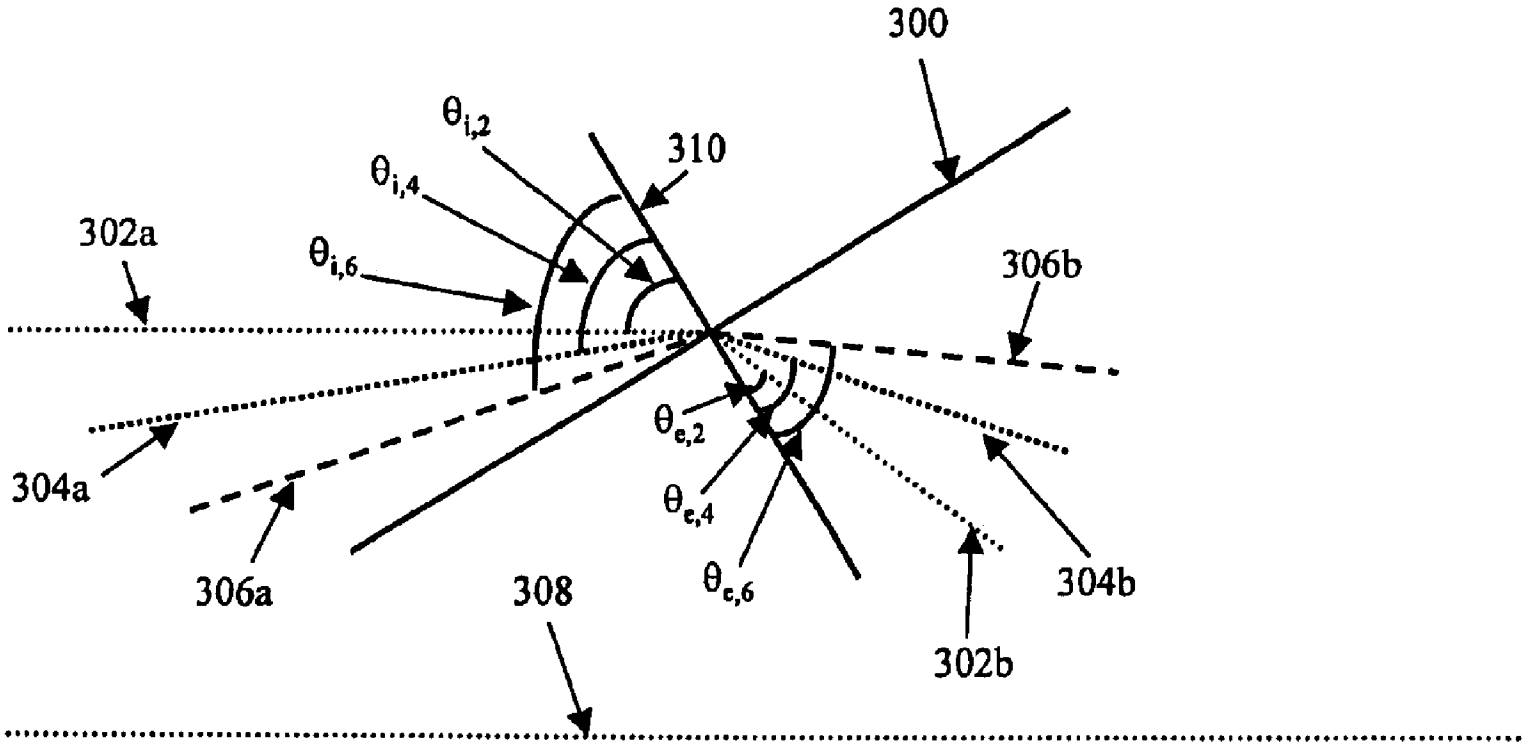
FIGS. 3*a*–3*c* are optical ray trace diagrams for radiation incident on different embodiments of the present invention.
Figure 3B:
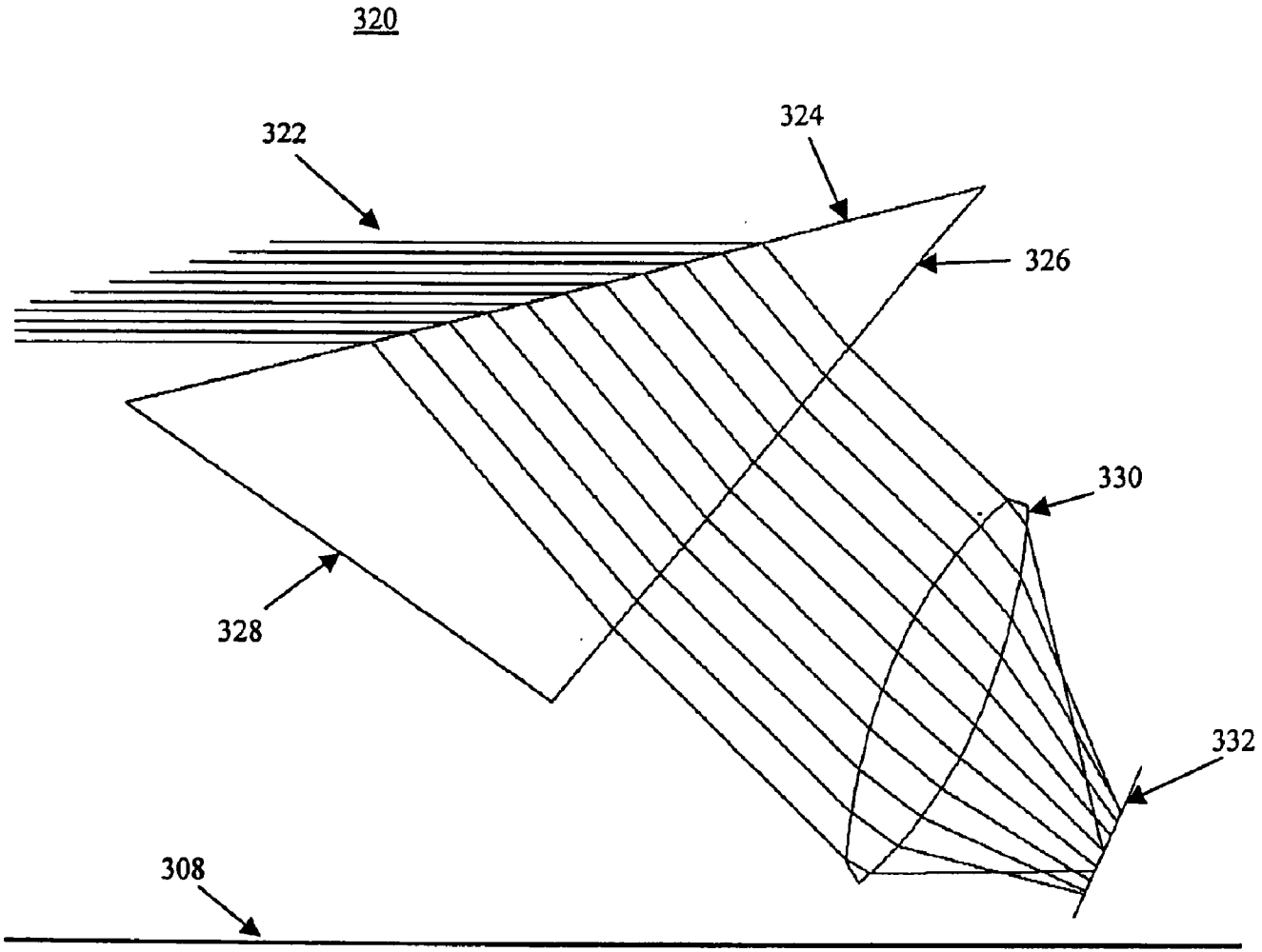

FIG. 3*a* is an optical ray trace diagram for a portion of a direction finding system in accordance with the first embodiment. Line 300 corresponds to the air/fused silica interface in which ray 302*a* is incident upon the fused silica window system. Ray 302*b* corresponds to ray 302*a* after refraction by the air/fused silica interface 300. Rays 304*a* and 306*a* correspond to rays incident on the air/fused silica interface at increasing angles of incidence. Similarly, rays 304*b* and 306*b* correspond to rays 304*a* and 306*a* after refraction by the air/fused silica interface, respectively. Line 308 is the window system optical axis. The window system optical axis 308, for a symmetric direction finding system mounted coaxially on a guided munition, will be coincident with a longitudinal axis of the guided munition. In other words, the direction finding system is boresighted with the guided munition, which is preferred. Similarly, because ray 302*a* is parallel with the window system optical axis 308, ray 302*a* is boresighted. $\theta_{i,2}$, $\theta_{i,4}$, and $\theta_{i,6}$, correspond to the angle of incidence of rays 302*a*, 304*a*, and 306*a*, respectively, relative to the normal axis 310 of the air/fused silica interface 302. $\theta_{i,2}$, corresponding to boresighted ray 302*a*, is deemed the boresight angle. $\theta_{e,2}$, $\theta_{e,4}$, and $\theta_{e,6}$, correspond to the exit angle of rays 302*b*, 304*b*, and 306*b*, respectively, relative to the normal axis 310 of the air/fused silica interface 302. As can be seen, the air/fused silica interface 302 magnifies small increases in the angle of incidence. For example, a small increase in the incidence angle, from $\theta_{i,2}$ to $\theta_{i,4}$, corresponding to rays 302*a* and 304*a*, creates a larger increase in the exit angle, from $\theta_{c,2}$ to $\theta_{c,4}$, for rays 302*b* and 304*b*. In other words, $\theta_{c,4}-\theta_{c,2}>\theta_{i,4}-\theta_{i,2}$. This angular amplification helps to increase direction finding system sensitivity to small changes in the angle of incidence.

FIG. 3*b* is an optical ray trace diagram 320 representing the special case when the radiation pulse 322 is parallel to the window system optical axis 308. The angle formed by interfaces 324 and 326 defines a window of the window system in the shape of a prism 328. The angles of prism 328 are such that when the radiation pulse 322 exits the prism, it transmits normally, i.e., perpendicularly, out of the prism 328. Inclusion of a lens 330, as found in a second embodiment of the present invention, allows collection and focussing of the radiation pulse 322 onto surface 332. Note that if a radiation pulse is not parallel to the window system optical axis 308, the lens 330 collects only a portion of the radiation pulse. As only a portion of this off parallel radiation pulse falls on the lens 330, the lens 330 focuses only a portion of the off parallel radiation pulse onto surface 332. Thus, the use of a lens 330 serves to further amplify small changes in the angle of incidence $\theta_i$, and thus increases system sensitivity. Note that surface 332 can correspond to several different objects. In the simplest case, surface 332 corresponds to the front surface of a radiation detector or of a radiation filter placed directly in front of a radiation detector. Alternatively, surface 332 can correspond to the end of an optical fiber. This optical fiber can then be readily routed to a location within the guided munition more amenable to placement of the radiation detectors. As another alternative, surface 332 can correspond to the plane of an optical iris. The optical iris would block a radiation pulse that exits the lens 330 at a high angle, such as one incident on the window system at a high angle relative to the window system optical axis 308. This would be desirable, as it would block stray radiation signals, such as those due to other laser designators reflected from other nearby targets.

Figure 3C:
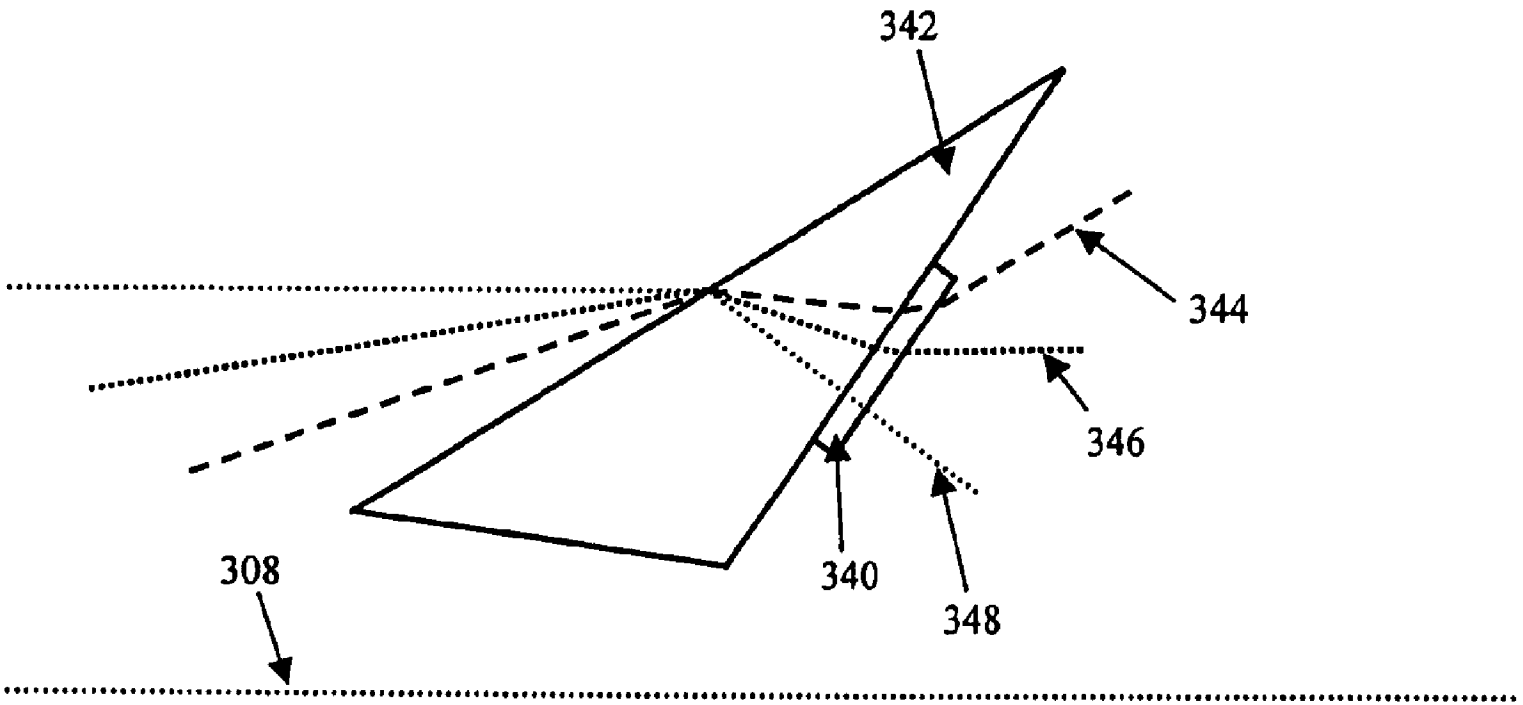

FIG. 3*c* corresponds to another embodiment of the present invention in which the transmittance of radiation as a function of incidence angle is further increased. In this embodiment, a dispersion element 340 is located adjacent to the fused silica/air interface of prism 342. The dispersion element 340 serves to further diffract the radiation based upon its angle of incidence, thereby providing greater angular sensitivity. The dispersion element 340 may take one of several forms including placing a film on the surface of the prism 342, or etching a pattern into the surface of the prism 342. Example dispersion elements include, but are not limited to, holograms, Fresnel lenses, and binary optics. As shown in FIG. 3*c*, the dispersion element 340 refracts ray 344 more than ray 346, which is refracted more than ray 348. If a lens, such as lens 330 shown in FIG. 3*b* is incorporated, this lens would collect all of ray 348, little of ray 346, and possibly none of ray 344. While FIG. 3*c* illustrates placement of the dispersion element 340 adjacent the inner surface of prism 342, it may be located any place within the radiation path, but preferably after the radiation has been transmitted through the window system.

Figure 4B:
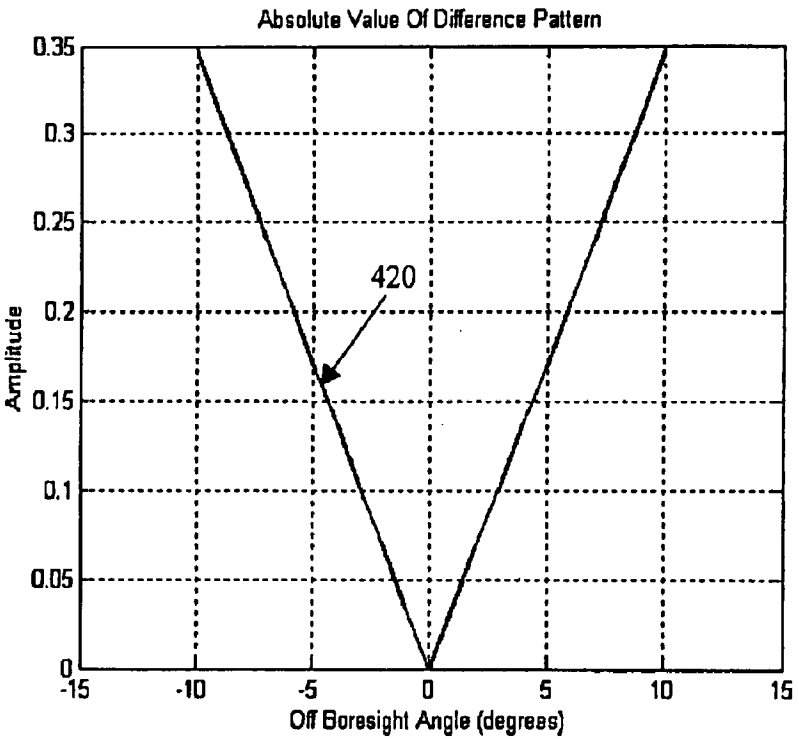
FIGS. 4*a*–4*d* are plots of various signals within the first embodiment of the present invention.
Figure 4A:
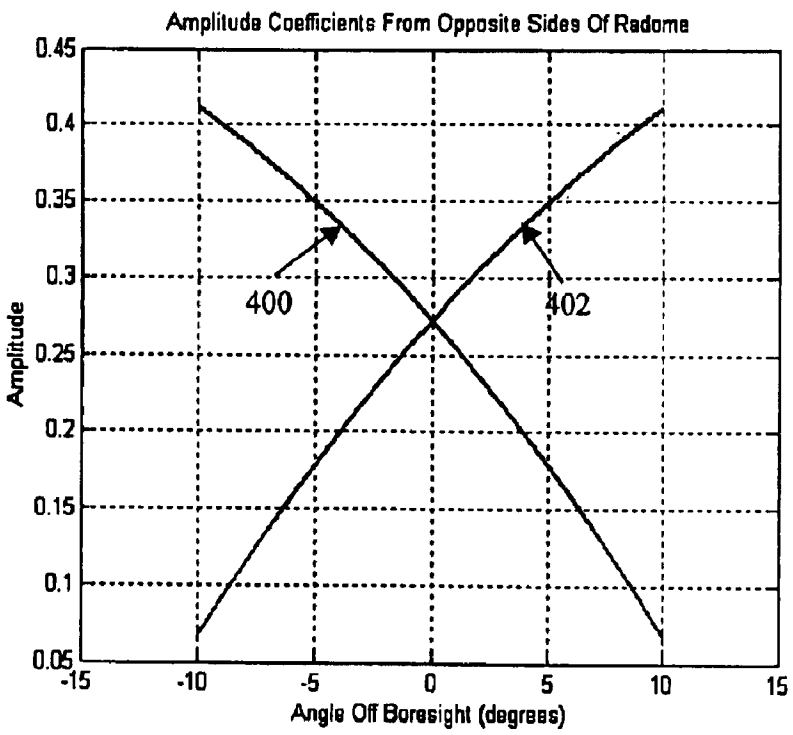
Figure 4D:
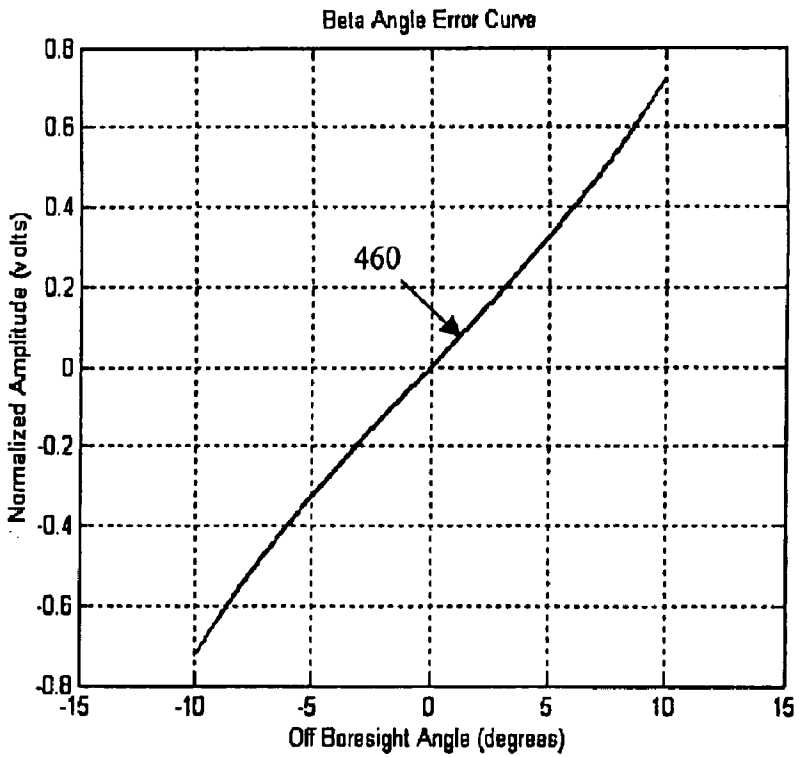
Figure 4C:
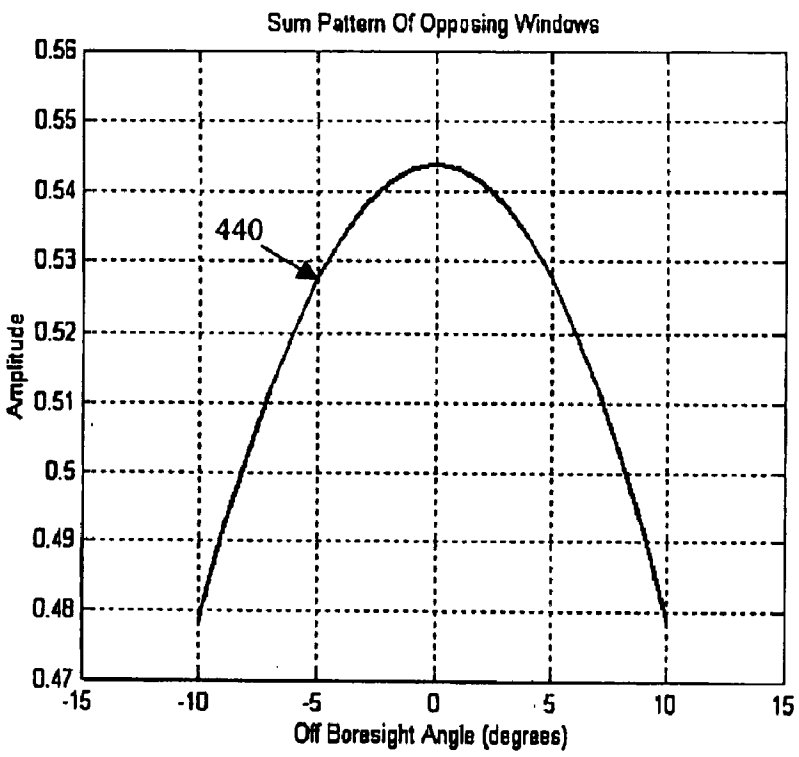

FIGS. 4*a*–4*d* illustrate various signals which may be generated within the direction finding system. FIG. 4*a* illustrates the detection signals of an opposing pair of radiation detectors, such as top and bottom radiation detectors or right and left radiation detectors. As an example, curve 400 corresponds to the detection signal of the left radiation detector and curve 402 corresponds to the detection signal of the right radiation detector. In this instance, the detection signal of the left radiation detector 400 is strongest when the radiation pulse is incident at an angle to the left off boresight and continuously decreases as the radiation pulse is incident at angles increasingly to the right off boresight. This decrease in the left detection signal is due to the decreasing Fresnel transmittance as the angle of incidence increases from left off boresight to right off boresight. FIG. 4*b* illustrates the absolute value of the difference 420 between the detection signals of the right and left radiation detectors 400, 402. FIG. 4*c* illustrates the sum 440 of the detection signals of the right and left radiation detectors. Lastly, FIG. 4*d* illustrates the difference of the right and left detection signals 420 divided by the sum of the right and left detection signals 440, creating a beta angle error curve 460. Guidance correction for guided munitions typically uses this beta angle error curve 460, as is well known within the art. The signals, and all manipulations thereof, may be conducted in either the analog or the digital domain. However, the digital domain is preferred, as implementing additional signal processing, such as noise reduction, is simpler.

Figure 5:
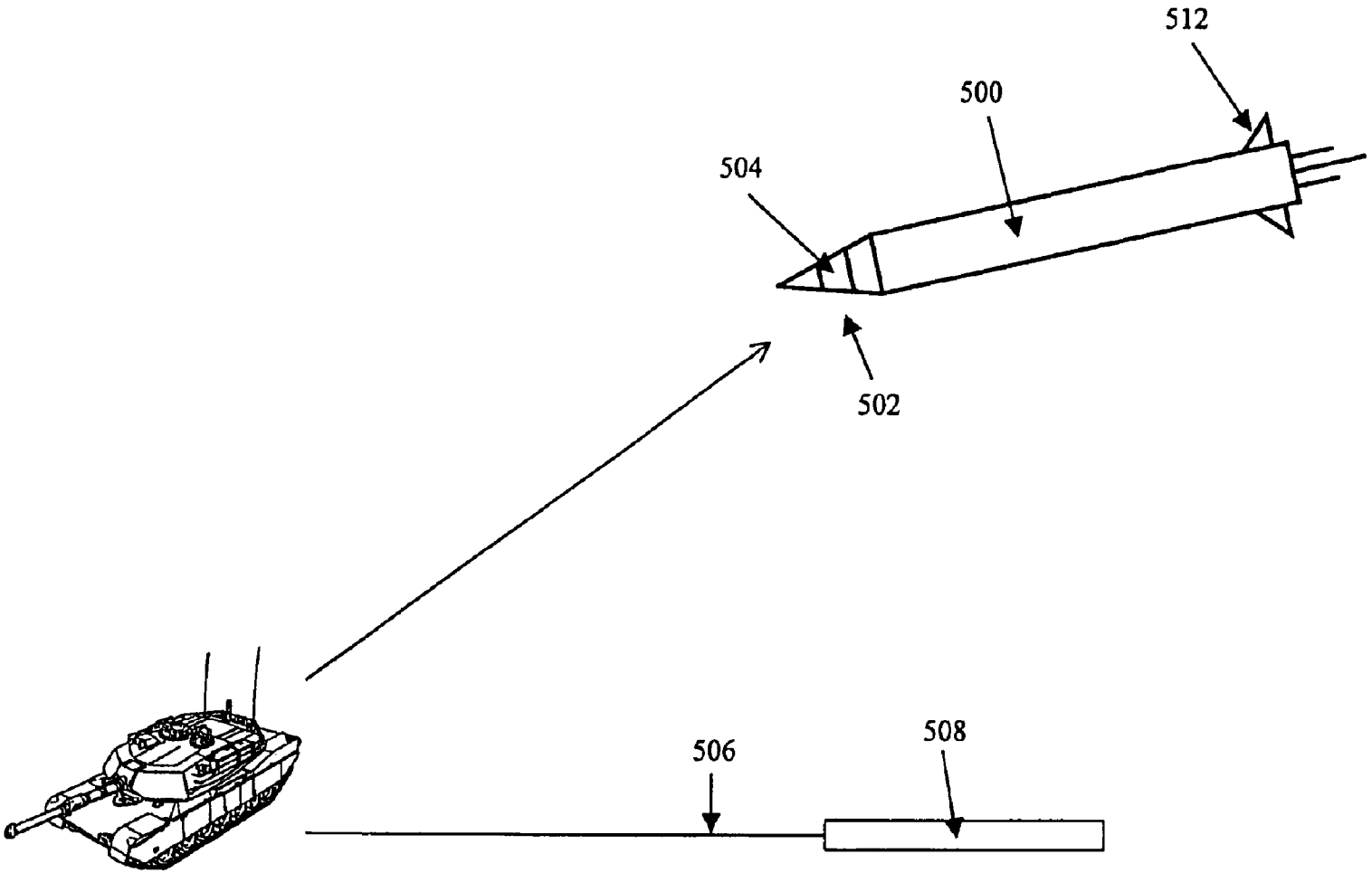
FIG. 5 illustrates application of an embodiment of the present invention.

The guided munition corrects its flight path based upon the bet a angle error curve. The process, well known in the guidance art, in abbreviated form, is as follows: upon receiving a radiation pulse, the radiation detectors generate corresponding detection signals. In the case of four radiation detectors, processing of opposing detection signals can determine the relative direction from which the radiation pulse arrived. Once a processor determines this relative direction, the processor compares it to the actual direction of the guided munition and generates a correction signal. The processor then applies this correction signal to control surfaces on the guided munition to modify its flight direction, as illustrated in FIG. 5. The goal of the guidance system is thus to alter the direction of the guided munition such that the beta angle error is nulled, i.e., the target is boresighted. The guided munition 500 includes a radome 502 incorporating a window system 504. Radiations 506 from a laser designator 508 reflects off a target 510, toward the guided munition 500. Upon detecting the reflected radiation 506, the guided munition processor applies the correction signal to control surface fins 512. The term control surfaces is general and can include fins 512 as illustrated which rotate in response to the correction signals or small thrusters that fire in response to the correction signals.

The above explanation used four radiation detectors to show how the detection signals of top and bottom or left and right opposing pairs of radiation detectors determine the angle of incidence off boresight. A direction finding system can use as few as three radiation detectors. By equi-spacing the radiation detectors around the perimeter of the radome, for example at twelve o'clock, four o'clock, and eight o'clock positions, three radiation detectors can provide all the signals required to determine relative direction off boresight. The radiation detector at the twelve o'clock position provides the complete needed "up" signal. The radiation detectors at the four and eight o'clock positions produce signals including "down" components as required to balance the "up" signal. Through the use of signal processing or a table look-up procedure, the four o'clock radiation detector signal can be decomposed into it's "down" and "right" signal components, respectively. Similarly, the eight o'clock radiation detector signal can be decomposed into it's "down" and "left" signal components. Summing the "down" signal components of the four and eight o'clock radiation detectors and then multiplying the sum by an appropriate weighting factor creates a pure "down" signal. This pure "down" signal, combined with the twelve o'clock radiation detector "up" signal provides a pure boresight signal in the "up"/"down" direction. Similarly, the "right" and "left" components of the four and eight o'clock radiation detector signals should provide a pure boresight signal in the "right"/"left" direction. Thus, one can generate pure boresight signals in both orthogonal directions, allowing generation of the appropriate beta angle error curves in both the "up"/"down" and "right"/"left" directions. Thus, by decomposing a radiation detector's signal into its two orthogonal components, summing, and weighting by the appropriate factor, any number of radiation detectors greater than two can be used to form a direction finding system. These three or more radiation detectors are preferably equi-spaced in the direction finding system. However, as long as the radiation detectors, as a group, provide both "up" and "down", as well as "right" and "left" signals, their positioning need not be equi-spaced.

While the description to this point has assumed a single element in each radiation detector, this is not required. If each radiation detector is actually two or more individual detector elements, additional noise reduction is possible. For example, by summing the signals from each individual detector element, the noise in the signal from one detector element will partially cancel the noise in the signal from another detector element. When two or more individual detector elements form each radiation detector, it is preferable to focus the radiation across all of the individual detector elements such that each is approximately equally illuminated by the radiation.

Figure 6:
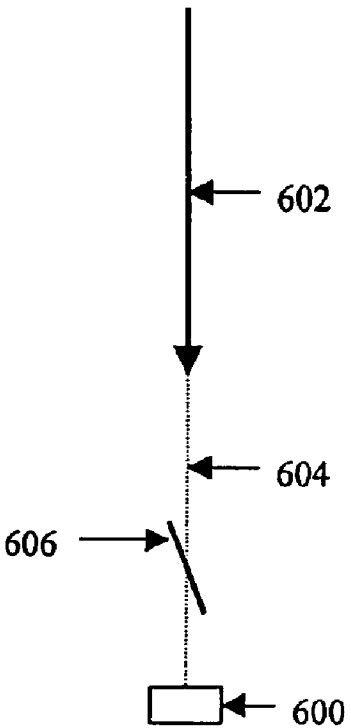
FIG. 6 illustrates an embodiment of the present detector using a radiation detector.

As a further alternative, a single radiation detector, instead of three or more, could be used. As noted above, a single radiation detector could provide direction information in a calibrated direction finding system. In this case, the magnitude of the detector signal would indicate the relative direction in a manner similar to curves 400 and 402 in FIG. 4*a*. The use of a single radiation detector leads to a window system that includes a single window. For a single window, defining a window system optical axis becomes simpler. The preferred method of defining the window system optical axis in this case uses both the position of the radiation detector and the desired direction of the radiation as seen in FIG. 6. FIG. 6 includes the radiation detector 600 and the desired direction of the radiation 602. The window system optical axis 604 is then coincident with the desired direction of the radiation 602 as it falls upon the radiation detector 600. The window system 606, a single window in this case, is then oriented such that the radiation is incident upon a surface of the window system 606 at an angle such that an instantaneous rate of change of the Fresnel transmittance as a function of angle of incidence at this angle is significantly different from zero. For the illustrated orientation of the window system 606, the radiation detector signal corresponds to curve 402 of FIG. 4*a*. Such a single radiation detector system is limited to providing relative direction information in only one dimension or direction, e.g., "up" and "down." This is in contrast to the above three or more radiation detector system that provides relative direction information in two orthogonal directions.

In another embodiment, the single radiation detector is composed of two or more elements. By using a properly designed reflector 104, the direction finding system 100 of FIG. 1 could use a single, multi-element radiation detector. In this case, the reflector would focus the radiation from different directions onto different elements within the single, multi-element radiation detector. Alternatively, fiber optics collecting radiation from different directions could couple the radiation to a single, multi-element radiation detector. As yet another alternative, a single semiconductor-based radiation detector having a single element, but three or more electrical contacts could provide the signals required for relative direction detection. The signal produced by each electrical contact in this multi-contact radiation detector is proportional to the distance between where the radiation falls on the detector and the contacts' location. Such single element, multi-contact detectors are well known in the electronics art.

Figure 7:
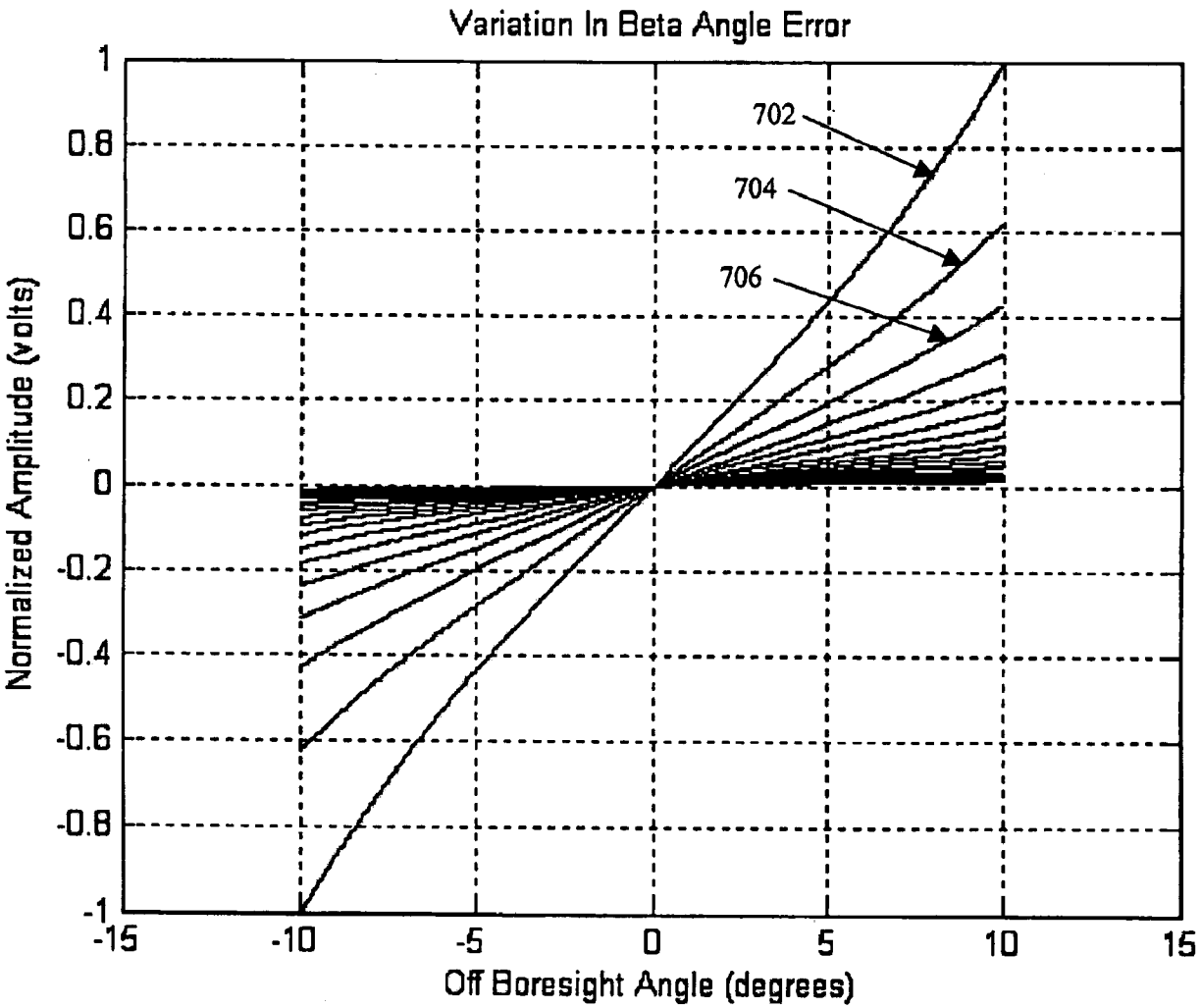
FIG. 7 is a plot showing the magnitude of signals within the first embodiment of the present invention as a function of the radome angle.

As illustrated in FIG. 2, greater angles of incidence lead to increased sensitivity in the resultant beta angle error curves. This result is born out in a computer simulation as shown in FIG. 7, which illustrates a normalized series of beta angle error curves assuming equal radiation energy at all angles of incidence. Curve 702 corresponds to the greatest angle of incidence, 80 degrees, while curves 704 and 706 correspond to 76 and 72 degree angles of incidence, respectively. As can be seen, the magnitude of the beta angle error curve, and thus sensitivity, is a strong function of incident angle. As the angle of incidence upon the window system increases, the amount of the radiation pulse incident on the detector decreases because the window system transmits less of the radiation pulse. Thus, for a given angle of incidence, increased sensitivity requires increasing the energy in the radiation pulse. As unlimited energy in the radiation pulse is not possible, an engineering trade-off between radiation pulse energy and the angle of incidence is required for a given direction finding system sensitivity.

Figure 8:
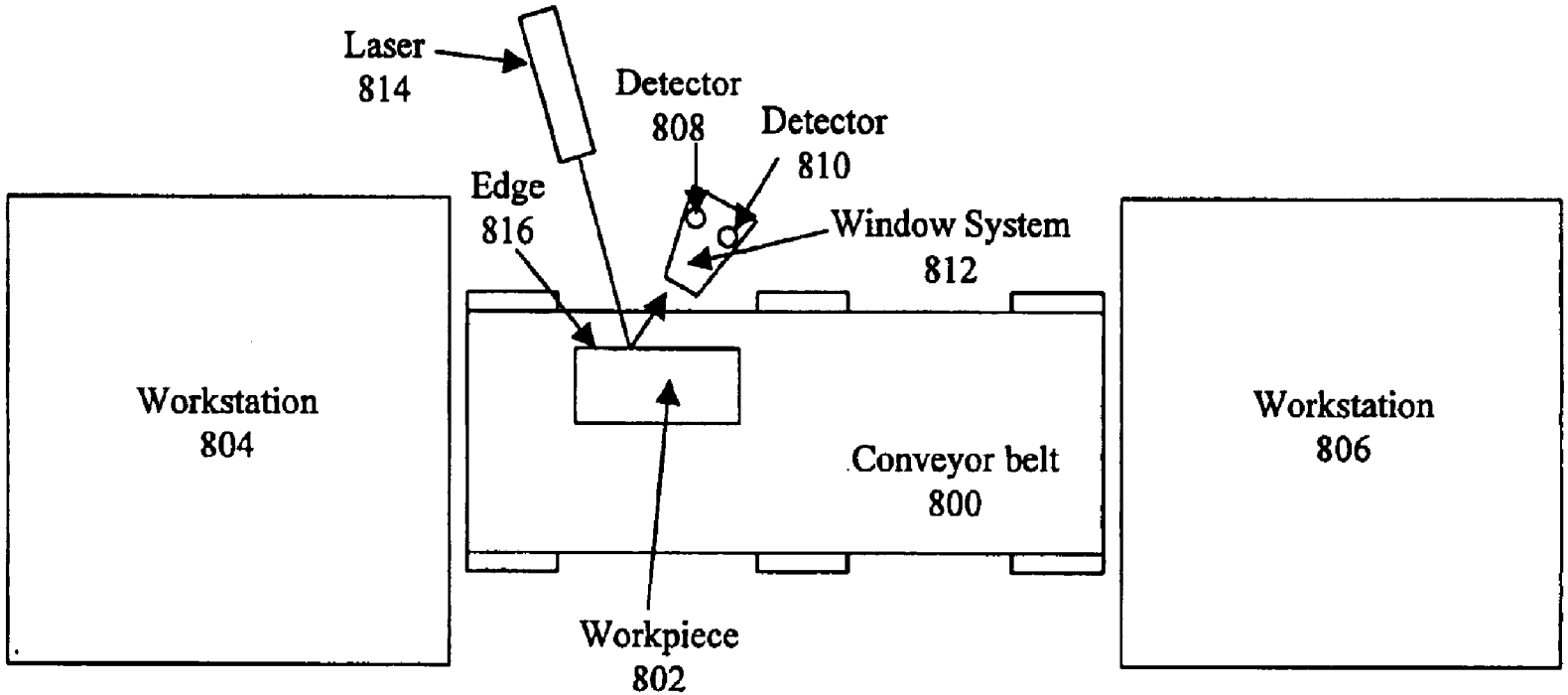
FIG. 8 illustrates application of another embodiment of the present invention.

The above description explained the operation of a direction finding system employing a pulsed radiation designator, as would be desirable when guiding a munition. However, in other applications the use of a continuous radiation designator may be feasible for illuminating targets. As an example illustrated in FIG. 8, a conveyor belt 800 guides a workpiece 802 from one workstation 804 to the next workstation 806 in a factory. By using a pair of radiation detectors 808, 810, a window system 812, and a low power laser 814, a direction finding system in accordance with another embodiment of the present invention can detect the location of an edge 816 of the workpiece 802. The direction finding system uses the output of the radiation detectors 808, 810 to create a beta angle error curve signal for guidance of the workpiece 802 to ensure its proper location for processing at the next workstation 806. The single radiation detector embodiment as illustrated in FIG. 6 is an alternative embodiment for use in workpiece guidance applications.

A further embodiment may not use any designator at all. For example, a target generating a high level of radiation itself, may need no external designator. Targets that generate high levels of radiation could be very hot targets, such as jet or missile engines or the exhaust systems of vehicles. In these cases, the preferred radiation detectors would be sensitive to infrared radiation, as the greatest amount of radiation from the target would be in the infrared. Other targets may emit high levels of visible radiation, such as a searchlight. In this case, the preferred radiation detectors would be sensitive in the visible portion of the radiation spectrum. When the target generates the radiation itself, narrow bandpass filters are typically not preferred, as this reduces the level of radiation received from the target, not just from the background.

Although the present invention has been fully described by way of examples with reference to the accompanying drawings, it is to be noted that various changes and modifications will be apparent to those skilled in the art. Therefore, such changes and modifications should be construed as being within the scope of the invention.

What is claimed is:

1. An apparatus for determining a relative direction of radiation comprising:

a window system for transmitting the radiation, the window system having a window system optical axis, the window system having Fresnel transmittance properties, the window system being configured such that if the radiation is parallel to the window system optical axis, the radiation is incident upon a surface of the window system at a boresight angle such that an instantaneous rate of change of the Fresnel transmittance as a function of angle of incidence at the boresight angle is significantly different from zero;

three or more radiation detectors for detecting the radiation, the radiation detectors being positioned relative to the window system so as to receive the radiation after transmission of the radiation through the window system, each of the radiation detectors generating a respective detection signal; and a processor for processing the respective detection signals, the processor being adapted to determine the relative direction of the radiation in two orthogonal directions with respect to the window system optical axis based upon the respective detection signals.

2. An apparatus in accordance with claim 1, wherein a thickness of the window system perpendicular to the window system optical axis varies along the window system optical axis.

3. An apparatus in accordance with claim 2, wherein the thickness of the window system perpendicular to the window system optical axis varies linearly.

4. An apparatus in accordance with claim 1, further comprising a lens system, the lens system for focusing the radiation on the radiation detectors, the lens system being located between the window system and the radiation detectors.

5. An apparatus in accordance with claim 1, further comprising a field of view limiter for limiting a field of view of the radiation detectors.

6. An apparatus in accordance with claim 5, wherein the field of view limiter is selected from the group consisting of light tubes, light baffles, and irises.

7. An apparatus in accordance with claim 1, wherein each of the radiation detectors is adapted to detect an optical monopulse.

8. An apparatus in accordance with claim 1, wherein each of the radiation detectors includes an optical bandwidth filter for transmitting a wavelength corresponding to the radiation, the optical bandwidth filter for substantially blocking wavelengths not corresponding to the radiation.

9. An apparatus in accordance with claim 1, wherein the Fresnel transmittance at the boresight angle is 90 percent or less.

10. An apparatus in accordance with claim 1, wherein the Fresnel transmittance at the boresight angle is 80 percent or less.

11. An apparatus in accordance with claim 1, wherein the Fresnel transmittance at the boresight angle is 70 percent or less.

12. An apparatus in accordance with claim 1, wherein the boresight angle is at least 60 degrees.

13. An apparatus in accordance with claim 1, wherein the boresight angle is at least 70 degrees.

14. An apparatus in accordance with claim 1, further comprising a dispersion element, the dispersion element being located in the radiation path between the window system and the radiation detectors.

15. An apparatus in accordance with claim 14, wherein the dispersion element is selected from the group consisting of a holographic element, a Fresnel lens element, and a binary optics element.

16. A guidable munition for striking a target designated by radiation, the guided munition comprising:

a body;

control means for controlling a direction of the guidable munition, the control means being responsive to a guidance signal, the control means being attached to the body;

a radome being attached to one end of the body, the radome including a window system for transmitting the radiation, the window system having a window system optical axis, the window system having Fresnel transmittance properties, the window system being configured such that if the radiation is parallel to the window system optical axis, the radiation is incident upon a surface of the window system at a boresight angle such that an instantaneous rate of change of the Fresnel transmittance as a function of angle of incidence at the boresight angle is significantly different from zero;

three or more radiation detectors for detecting the radiation, the radiation detectors for receiving the radiation after transmission of the radiation through the window system, each of the three or more radiation detectors for generating a respective detection signal; and a processor for processing each of the respective detection signals, the processor being adapted to determine a relative direction of the radiation in two orthogonal directions with respect to the window system optical axis based processing of the respective detection signals, the processor being adapted to generate the guidance signal based upon the relative direction of the radiation with respect to the window system optical axis.

17. A guidable munition in accordance with claim 16, wherein the control means is selected from the group consisting of fins and thrusters.

18. A guidable munition in accordance with claim 16, further comprising a lens system, the lens system for focusing the radiation on the radiation detectors, the lens system being located between the window system and the radiation detectors.

19. A guidable munition in accordance with claim 16, further comprising a field of view limiter for limiting a field of view of the radiation detectors.

20. A guidable munition in accordance with claim 16, wherein each of the radiation detectors is adapted to detect an optical monopulse.

21. A guidable munition in accordance with claim 16, wherein each of the radiation detectors includes an optical bandwidth filter for transmitting a wavelength corresponding to the radiation, the optical bandwidth filter for substantially blocking wavelengths not corresponding to the radiation.

22. A guidable munition in accordance with claim 16, wherein the Fresnel transmittance at the boresight angle is 90 percent or less.

23. A guidable munition in accordance with claim 16, wherein the Fresnel transmittance at the boresight angle is 80 percent or less.

24. A guidable munition in accordance with claim 16, wherein the Fresnel transmittance at the boresight angle is 70 percent or less.

25. A guidable munition in accordance with claim 16, wherein the boresight angle is at least 60 degrees.

26. A guidable munition in accordance with claim 16, wherein the boresight angle is at least 70 degrees.

27. A guidable munition in accordance with claim 16, further comprising a dispersion element, the dispersion element being located in the radiation path between the window system and the radiation detectors.

28. A method for determining a direction of radiation, the method comprising the steps of:

transmitting the radiation through a window system, the window system having a window system optical axis, the window system having Fresnel transmittance properties, the window system being configured such that if the radiation is parallel to the window system optical axis, the radiation is incident upon a surface of the window system at a boresight angle such that an instantaneous rate of change of the Fresnel transmittance as a function of angle of incidence at the boresight angle is significantly different from zero;

detecting the thus transmitted radiation with three or more radiation detectors, each of the radiation detectors thereby generating a respective detection signal; and processing the respective detection signals, thereby determining the relative direction of the radiation in two orthogonal directions with respect to the window system optical axis.

29. A method in accordance with claim 28, further comprising the step of focusing the radiation on the three or more radiation detectors using a lens system, the lens system being located between the window system and the radiation detectors.

30. A method in accordance with claim 28, further comprising the step of limiting a field of view of the radiation detectors.

31. A method in accordance with claim 28, wherein each of the radiation detectors is adapted to detect an optical monopulse.

32. A method in accordance with claim 28, further comprising the step of filtering the radiation before the step of detecting the thus transmitted radiation, the step of filtering substantially blocking wavelengths not corresponding to the radiation.

33. A method in accordance with claim 28, wherein the Fresnel transmittance at the boresight angle is 90 percent or less.

34. A method in accordance with claim 28, wherein the Fresnel transmittance at the boresight angle is 80 percent or less.

35. A method in accordance with claim 28, wherein the Fresnel transmittance at the boresight angle is 70 percent or less.

36. A method in accordance with claim 28, wherein the boresight angle is at least 60 degrees.

37. A method in accordance with claim 28, wherein the boresight angle is at least 70 degrees.

38. A method in accordance with claim 28, further comprising the step of dispersing the radiation before the step of detecting the thus transmitted radiation.

39. An apparatus for determining a direction of radiation comprising:

a window system for transmitting the radiation, the window system having a window system optical axis, the window system having Fresnel transmittance properties, the window system being configured such that if the radiation is parallel to the window system optical axis, the radiation is incident upon a surface of the window system at a boresight angle such that an instantaneous rate of change of the Fresnel transmittance as a function of angle of incidence at the boresight angle is significantly different from zero;

a radiation detector for detecting the radiation, the radiation detector being positioned relative to the window system so as to receive the radiation after transmission of the radiation through the window system, the radiation detector generating one or more detection signals; and a processor for processing the one or more detection signals, the processor being adapted to determine the relative direction of the radiation with respect to the window system optical axis based upon the at least one detection signal.

40. An apparatus in accordance with claim 39, further comprising a lens system, the lens system for focusing the radiation on the radiation detector, the lens system being located between the window system and the radiation detector.

41. An apparatus in accordance with claim 39, further comprising a field of view limiter for limiting a field of view of the radiation detector.

42. An apparatus in accordance with claim 39, wherein the radiation detector is adapted to detect an optical monopulse.

43. An apparatus in accordance with claim 39, wherein the radiation detector includes an optical bandwidth filter for transmitting a wavelength corresponding to the radiation, the optical bandwidth filter for substantially blocking wavelengths not corresponding to the radiation.

44. An apparatus in accordance with claim 39, wherein the Fresnel transmittance at the boresight angle is 90 percent or less.

45. An apparatus in accordance with claim 39, wherein the Fresnel transmittance at the boresight angle is 80 percent or less.

46. An apparatus in accordance with claim 39, wherein the Fresnel transmittance at the boresight angle is 70 percent or less.

47. An apparatus in accordance with claim 39, wherein the boresight angle is at least 60 degrees.

48. An apparatus in accordance with claim 39, wherein the boresight angle is at least 70 degrees.

49. An apparatus in accordance with claim 39, further comprising a dispersion element, the dispersion element being located in the radiation path between the window system and the radiation detector.

50. An apparatus for determining a direction of radiation comprising:

a window system for transmitting the radiation, the window system having a window system optical axis, the window system having Fresnel transmittance properties, the window system being configured such that if the radiation is parallel to the window system optical axis, the radiation is incident upon a surface of the window system at a boresight angle such that an instantaneous rate of change of the Fresnel transmittance as a function of angle of incidence at the boresight angle is significantly different from zero;

two radiation detectors for detecting the radiation, the two radiation detectors being positioned relative to the window system so as to receive the radiation after transmission of the radiation through the window system, each of the two radiation detectors generating a respective detection signal; and a processor for processing the one or more detection signals, the processor being adapted to determine the relative direction of the radiation in one dimension with respect to the window system optical axis based upon the respective detection signals.

51. An apparatus in accordance with claim 50, further comprising a lens system, the lens system for focusing the radiation on the radiation detectors, the lens system being located between the window system and the radiation detectors.

52. An apparatus in accordance with claim 50, further comprising a field of view limiter for limiting a field of view of the radiation detectors.

53. An apparatus in accordance with claim 50, wherein each of the radiation detectors is adapted to detect an optical monopulse.

54. An apparatus in accordance with claim 50, wherein each of the radiation detectors includes an optical bandwidth filter for transmitting a wavelength corresponding to the radiation, the optical bandwidth filter for substantially blocking wavelengths not corresponding to the radiation.

55. An apparatus in accordance with claim 50, wherein the Fresnel transmittance at the boresight angle is 90 percent or less.

56. An apparatus in accordance with claim 50, wherein the Fresnel transmittance at the boresight angle is 80 percent or less.

57. An apparatus in accordance with claim 50, wherein the Fresnel transmittance at the boresight angle is 70 percent or less.

58. An apparatus in accordance with claim 50, wherein the boresight angle is at least 60 degrees.

59. An apparatus in accordance with claim 50, wherein the boresight angle is at least 70 degrees.

60. An apparatus in accordance with claim 50, further comprising a dispersion element, the dispersion element being located in the radiation path between the window system and the radiation detectors.

* * * * *